US009387529B2

(12) United States Patent
Staats et al.

(10) Patent No.: US 9,387,529 B2
(45) Date of Patent: Jul. 12, 2016

(54) FORMING PRESS

(71) Applicant: Honda Motor Co., Ltd., Tokyo (JP)

(72) Inventors: Douglas O. Staats, West Liberty, OH (US); Milan Jurich, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 369 days.

(21) Appl. No.: 13/836,515

(22) Filed: Mar. 15, 2013

(65) Prior Publication Data

US 2014/0260498 A1 Sep. 18, 2014

(51) Int. Cl.

| | |
|---|---|
| ***B30B 15/00*** | (2006.01) |
| ***B21D 22/22*** | (2006.01) |
| ***B21J 9/18*** | (2006.01) |
| ***B21D 28/20*** | (2006.01) |
| ***B30B 1/26*** | (2006.01) |

(52) U.S. Cl.

CPC ..... *B21D 22/22* (2013.01); *B21D 28/20* (2013.01); *B21J 9/18* (2013.01); *B30B 1/26* (2013.01); *B30B 1/263* (2013.01); *B30B 15/0035* (2013.01)

(58) Field of Classification Search

CPC ..... B21D 22/22; B21D 28/20; B30B 1/26; B30B 1/263; B30B 15/0035; B21J 9/18

See application file for complete search history.

(56) References Cited

U.S. PATENT DOCUMENTS

| | | | | |
|---|---|---|---|---|
| 1,544,573 | A * | 7/1925 | Glasner | B21D 24/14 192/150 |
| 1,562,988 | A * | 11/1925 | Nelson | B21D 24/08 100/269.08 |
| 3,143,007 | A * | 8/1964 | Thompson | B21J 9/20 72/257 |
| 3,863,488 | A | 2/1975 | Deordiev et al. | |
| 4,488,237 | A | 12/1984 | Aronson et al. | |
| 4,615,204 | A * | 10/1986 | Yamamoto et al. | 72/347 |
| 4,819,473 | A | 4/1989 | Jansen | |
| 4,996,864 | A | 3/1991 | Enami | |
| 6,871,586 | B2 | 3/2005 | Teraoka | |
| 7,102,316 | B2 | 9/2006 | Beyer et al. | |
| 7,165,437 | B2 | 1/2007 | Shin et al. | |
| 7,421,878 | B2 | 9/2008 | Iwashita et al. | |
| 7,958,765 | B2 | 6/2011 | Baba et al. | |
| 2006/0201226 | A1 * | 9/2006 | Laupheimer et al. | 72/351 |
| 2009/0090161 | A1 | 4/2009 | Amino | |
| 2011/0045113 | A1 | 2/2011 | Miyasaka et al. | |
| 2011/0290125 | A1 | 12/2011 | Ito et al. | |

FOREIGN PATENT DOCUMENTS

| | | |
|---|---|---|
| DE | 4125992 | 2/1993 |
| DE | 102008011375 | 9/2009 |

OTHER PUBLICATIONS

International Search Report and Written Opinion of PCT/US2014/021058 dated Aug. 26, 2014, 13 pages.

* cited by examiner

*Primary Examiner* — David B Jones
(74) *Attorney, Agent, or Firm* — Rankin, Hill & Clark LLP

(57) ABSTRACT

A draw press includes a carriage moveable toward a work piece and an upper die movably secured to the carriage. The upper die is movable with respect to the carriage to draw the work piece. A method for drawing a metal part is also disclosed.

49 Claims, 5 Drawing Sheets

FORMING PRESS

BACKGROUND

Some metals such as aluminum are less formable in a conventional forming press when compared to steel. Deep drawing of aluminum to form deep drawn parts, such as vehicle door inner panels, also presents many challenges. Some vehicle manufacturers have more than four press stages in manufacturing lines, some including two draw stages, which can improve the ability to form deep drawn aluminum parts. Increasing the press stages, however, results in additional capital costs as well as more time and energy required to manufacture these deep drawn parts.

SUMMARY

In view of the foregoing, a new draw press is provided. Such a draw press includes a carriage and an upper die. The carriage is moveable toward a work piece. The upper die is movably secured to the carriage. The upper die is movable with respect to the carriage to draw the work piece.

A method for drawing a metal part includes moving a carriage and an upper die operably connected thereto toward a work piece positioned on a lower die. The method further includes moving the upper die with respect to the carriage to draw the work piece.

Another non-limiting example of a draw press includes a lower die, a blankholder, a movable body and a carriage. The blankholder is for supporting a work piece positioned on the lower die. The carriage is movably secured to the body and positioned between the lower die and the body. The blankholder extends from the carriage and the carriage is movable between the body and the lower die to selectively position the blankholder.

Another non-limiting example of a draw press includes a first movable carriage, an upper die, a lower die, a blankholder, a movable body and a second carriage. The upper die is movably secured to the carriage. The blankholder is for supporting a work piece positioned on the lower die. The second carriage is movably secured to the body and positioned between the lower die and the body. The blankholder extends from the second carriage and the second carriage is movable between the body and the lower die to selectively position the blankholder.

Another non-limiting example of a method for drawing a metal part includes providing a carriage and an upper die movably secured to the carriage; moving the carriage toward a work piece positioned on a lower die and a blankholder; engaging the work piece with the upper die; moving the upper die with respect to the carriage and drawing the work piece with the upper die; and disengaging the blankholder from the work piece.

Another non-limiting example of a draw press includes an upper die, a first drive mechanism, and a second drive mechanism. The first drive mechanism is operably connected to the upper die to move the upper die to draw a work piece a first depth. The second drive mechanism operably connected to the upper die to move the upper die to draw the work piece to a second depth.

Another non-limiting example of a method for drawing a metal part includes moving an upper die with a first drive mechanism toward a work piece positioned on a lower die; and moving the upper die with a second drive mechanism to draw the work piece.

Another example of a draw press includes a frame, a first drive mechanism, a cushion slide, a cushion plate, a lower die, a blankholder and a second drive mechanism. The first drive mechanism connects with the frame. The cushion slide is movably connected with the frame and operably connected with the first drive mechanism. The cushion slide is driven by the first drive mechanism so as to be movable with respect to the frame a first distance in a first direction. The second drive mechanism is secured to the cushion slide for movement therewith and is operably connected to the cushion plate. The cushion plate is positioned between the lower die and cushion slide. The blankholder connects with and is spaced from the cushion plate. The second drive mechanism allows for movement of the blankholder a second distance in the first direction. The second distance is shorter than the first.

DETAILED DESCRIPTION

Figure 1:
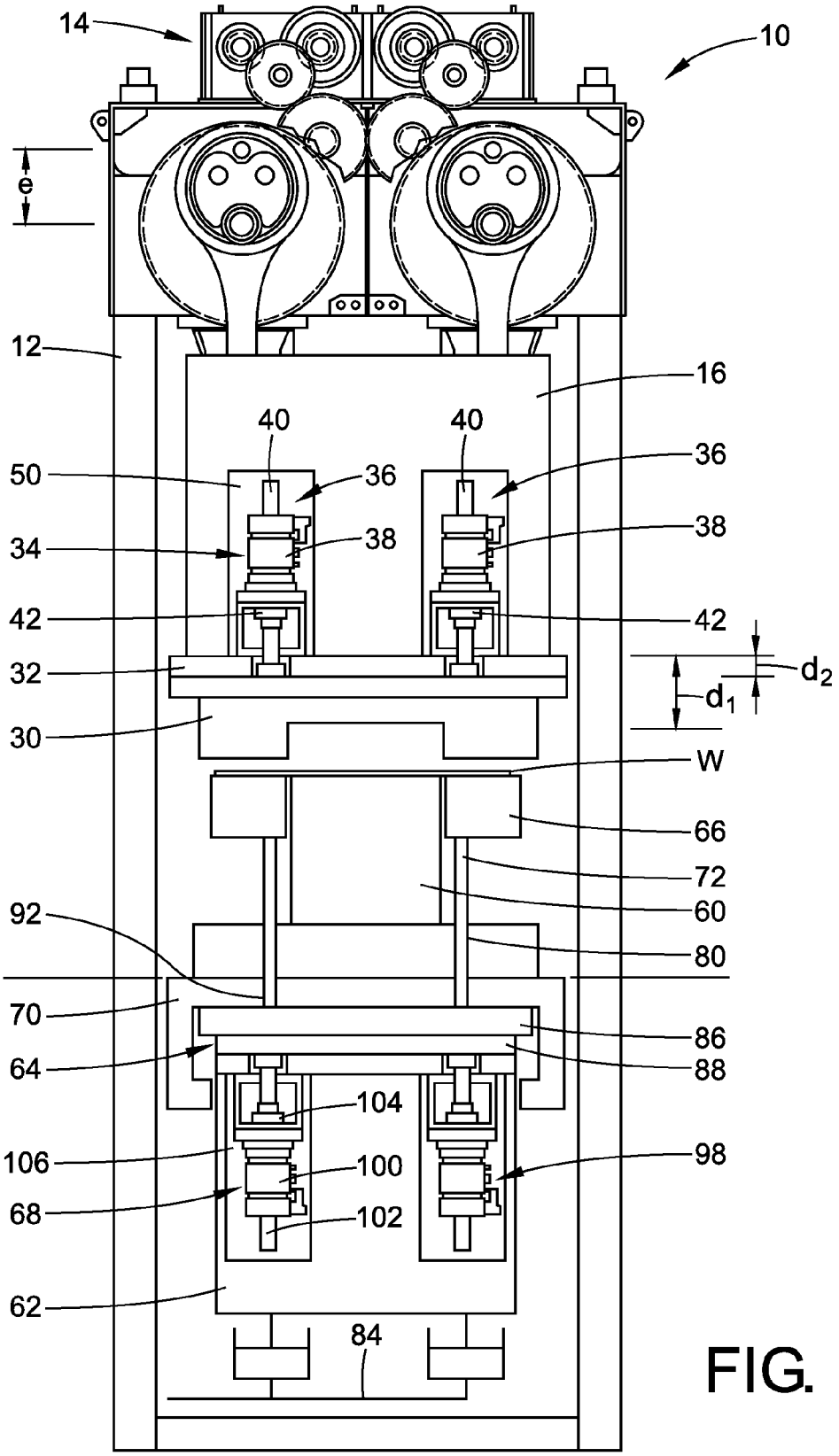
FIG. 1 is a schematic depiction of a draw press.

FIG. 1 schematically depicts a draw press 10 used to form a deep drawn part from a metal or metal alloy sheet, hereinafter referred to as a work piece W. The draw press 10 includes a frame 12 (schematically depicted). The frame 12 can be similar to frames found in conventional draw presses.

Figure 2:
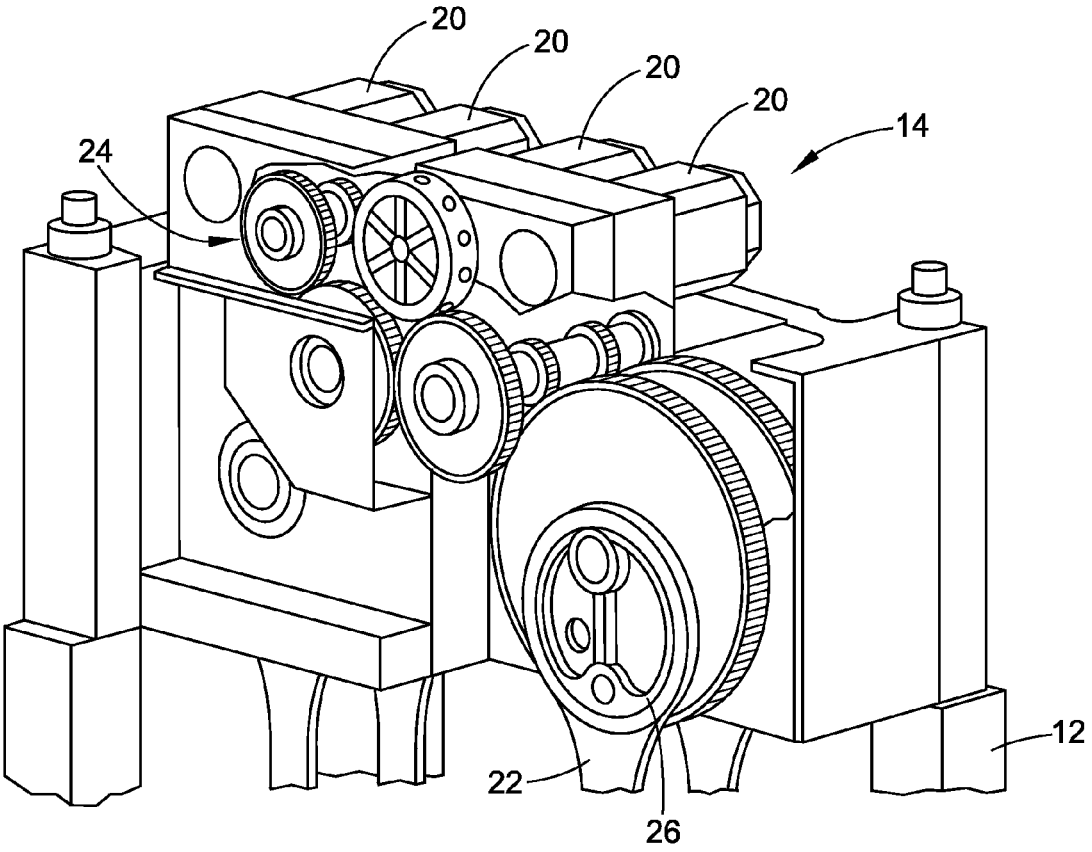
FIG. 2 is a perspective view of a first drive mechanism of the draw press of FIG. 1.

The draw press 10 includes a first drive mechanism 14 connected to the frame 12. A first carriage 16, hereinafter referred to as the slide 16, is movably connected with the frame 12 and operably connected with the first drive mechanism 14. The slide 16 is driven by the first drive mechanism 14 so as to be movable with respect to the frame 12 a first distance $d_1$ in a first (downward in FIG. 1) direction. The first drive mechanism 14 in the illustrated embodiment is an eccentric drive mechanism and the first distance $d_1$, i.e. the distance that the slide 16 is movable with respect to the frame 12, is a function of the eccentricity e of the first drive mechanism 14. The first drive mechanism 14 being an eccentric drive mechanism allows for relatively quick movement of the slide 16 with respect to the frame, which is beneficial for the productivity of the draw press 10. It is to be understood however, that the first drive mechanism 14 may be any drive mechanism and is not limited to eccentric drive mechanisms. In a non-limiting example as shown in FIG. 2, the first drive mechanism 14 includes a plurality of servomotors (hereinafter "first drive mechanism servomotors") 20 operably connected with connecting rods 22 through a gear train 24 and eccentric rings 26. The first drive mechanism 14 can be similar to conventional eccentric drive mechanisms found in conventional draw presses.

With reference back to FIG. 1, the draw press 10 also includes an upper die 30. The upper die 30 can be similar to conventional upper dies used with conventional draw presses. The upper die 30 is movably secured to the slide 16. In a non-limiting example, an upper die mounting plate 32, is positioned between the upper die 30 and the slide 16. In the illustrated embodiment, the upper die 30 mounts to the upper die mounting plate 32, which mounts to the slide 16. The draw press 10 also includes a second drive mechanism 34 secured to the slide 16 for movement therewith, and the second drive mechanism 34 is also operably connected to the upper die 30 to extend the upper die 30 from the slide 16 a second distance $d_2$ in the first (downward) direction. In an embodiment, the second distance $d_2$ is shorter than, or less than, the first distance $d_1$.

In a non-limiting example, the second drive mechanism 34 includes a plurality of servospindles 36 (two are depicted in FIG. 1) each connected with the slide 16 for movement therewith. In other words, the second drive mechanism 34 is fixed to the slide 16 such that when the slide 16 moves the second drive mechanism 34 also moves. Each servospindle 36 includes a servomotor (hereinafter "second drive mechanism servomotor") 38 connected with a spindle 40, which cooperates with a spindle nut 42. The second drive mechanism 34 can also be referred to as a servospindle drive mechanism. Each servospindle 36 is operably connected to the upper die 30 through the upper die mounting plate 32 to extend the upper die 30 from the slide 16. As illustrated, the slide 16 includes a cavity 50 (a plurality of cavities 50 is provided in the illustrated embodiment). Each servospindle 36, or at least the second drive mechanism servomotor 38, is received in a respective cavity 50. The servospindles 36 could be mounted outside the slide 16, operating an upper die mounting plate that is larger than the slide dimensions where clearance allows. Alternatively, each servospindle 36 could be mounted near a top of the slide 16, moving a structure, which is connected with the upper die 30, within the slide 16. The servospindles could operate by having the second drive mechanism servomotor 36 drive the spindle 40 with respect to the spindle nut 42, or vice versa where the spindle nut 42 is driven with respect to the spindle 40. Each spindle 40 connects with the upper die mounting plate 32 and can extend from the cavity 50 when the corresponding servomotor 38 is activated accordingly. As will be described in more detail below, the second drive mechanism 34 can be configured to pulsate the upper die 30 with respect to the slide 16. This pulsating movement can occur at a frequency greater than about 15 Hz. In an embodiment, the upper die can be pulsated at about 50 Hz.

In an embodiment, the draw press 10 includes a lower die 60, a movable body 62 (hereinafter referred to as "the cushion slide 62"), a carriage 64, a blankholder 66 and a carriage drive mechanism 68. The draw press 10 further includes a bolster 70. A pin 72 connects the blankholder 66 to the carriage 64. A plurality of pins 72 is provided to connect the blankholder 66 to the carriage 64.

The lower die 60 can be similar to lower dies found in conventional draw presses. In the illustrated embodiment, the lower die 60 includes openings 80 through which the pins 72 extend to connect the blankholder 66 with the carriage 64.

As illustrated, the cushion slide 62 may be generally box-shaped. An energy recovery mechanism including, but not limited to, a hydraulic cylinder 82 (two hydraulic cylinders are depicted in FIG. 1 and a plurality of hydraulic cylinders can be provided) is provided below the cushion slide 62. The hydraulic cylinders 82 can be electrically operated to absorb some of the force applied by the upper die 30 to the blankholder 66. Such a force is transferred from the blankholder to the cushion slide 62 so that the cushion slide 62 is moved towards the hydraulic cylinder 82 to compress the hydraulic cylinder 82. Hydraulic lines 84 connected with the cylinders 82 transfer fluid to an energy regeneration system (not shown) that increases the efficiency of the draw press 10. Pushing the hydraulic cylinders 82 down forces hydraulic fluid through hydraulic pumps opposite the direction the fluid flows when the pumps run to provide pressure. This runs the pump motors backwards, turning them into generators. The hydraulic cylinders 82 provide a resisting force transmitted through the die pins 72 to the blankholder 66 to the slide 16, which results in the force clamping the work piece W between the upper die 30 and the blankholder 66. This force can be controlled throughout the stroke.

The carriage 64 is positioned between the lower die 60 and the cushion slide 62. In a non-limiting example, the carriage 64 includes a pin plate 86 and a cushion plate 88. The pin plate 86 is disposed on top of the cushion plate 88. The pins 72 connect with and extend from the pin plate 86 and move with the cushion plate 88. The bolster 70, which includes openings 92 through which the pins 72 extend, limits further upward travel of the carriage 64. However, other configurations may be used for the carriage 64. For example, the carriage 64 may be a single integral piece, or may include more than two parts. The carriage 64 is movable with the cushion slide 62, for example for the primary drawing operation where the eccentric drive mechanism is moving the slide 16 and the upper die 30 downward with respect to the lower die 60. The carriage 64 is also movable with respect to the cushion slide 62, such as during a secondary drawing operation where the upper die 30 is moving with respect to the slide 16 and the lower die 60 further downward using the second drive mechanism 34 connected with the slide 16 and the upper die 30.

In another embodiment, the draw press 10 includes a frame 12, a lower die 60, a movable body 62 (hereinafter referred to as "the cushion slide 62"), a pin plate 86, a cushion plate 88, a blankholder 66, and a cushion plate drive mechanism 68. The draw press 10 further includes a bolster 70. A plurality of pins 72 connect the blankholder 66 to the pin plate 86 which is operably connected to the cushion plate 88.

The blankholder 66 is connected with and spaced from the carriage 64. The blankholder 66 and the pins 72 connecting the blankholder 66 to the carriage 64 can be similar to known blankholder and known pins.

In an embodiment, the carriage drive mechanism 68 is secured to the cushion slide 62 for movement therewith. In the illustrated embodiment, the carriage drive mechanism 68 includes a plurality of servospindles 98 similar to the servospindles 36 described above. As such, each servospindle 98 includes a servomotor 100, a spindle 102, and a spindle nut 104. The servomotor 100 can drive the spindle 102 with respect to the spindle nut 104, or vice versa and drive the spindle nut 104 with respect to the spindle 102. The cushion slide 62 includes a cavity 106 (or a plurality of cavities to accommodate each servospindle 98) and a respective servomotor 100 of the carriage drive mechanism 68 is positioned within the cavity 106. The spindles 102 extend from the cushion slide 62 to connect with the carriage 64 and each servomotor 100 is configured to provide for pulsating movement of the carriage 64 with respect to the cushion slide 62. The servospindles 98 could be mounted outside the cushion slide 62, operating a pin plate 86 and cushion plate 88 that is larger than the cushion slide dimensions. Alternatively, each servospindle 98 could be mounted near a bottom of the cushion slide 62, moving a structure, which is connected with the blankholder 66, within the cushion slide 62.

Operation of the draw press 10 will now be described in accordance with an embodiment of the present disclosure. More specifically, a method for drawing a metal part will be described. Even though the method will be described with reference to the draw press 10 described above, the method described below and also referred in the claims could be used with other draw presses.

Figure 3:
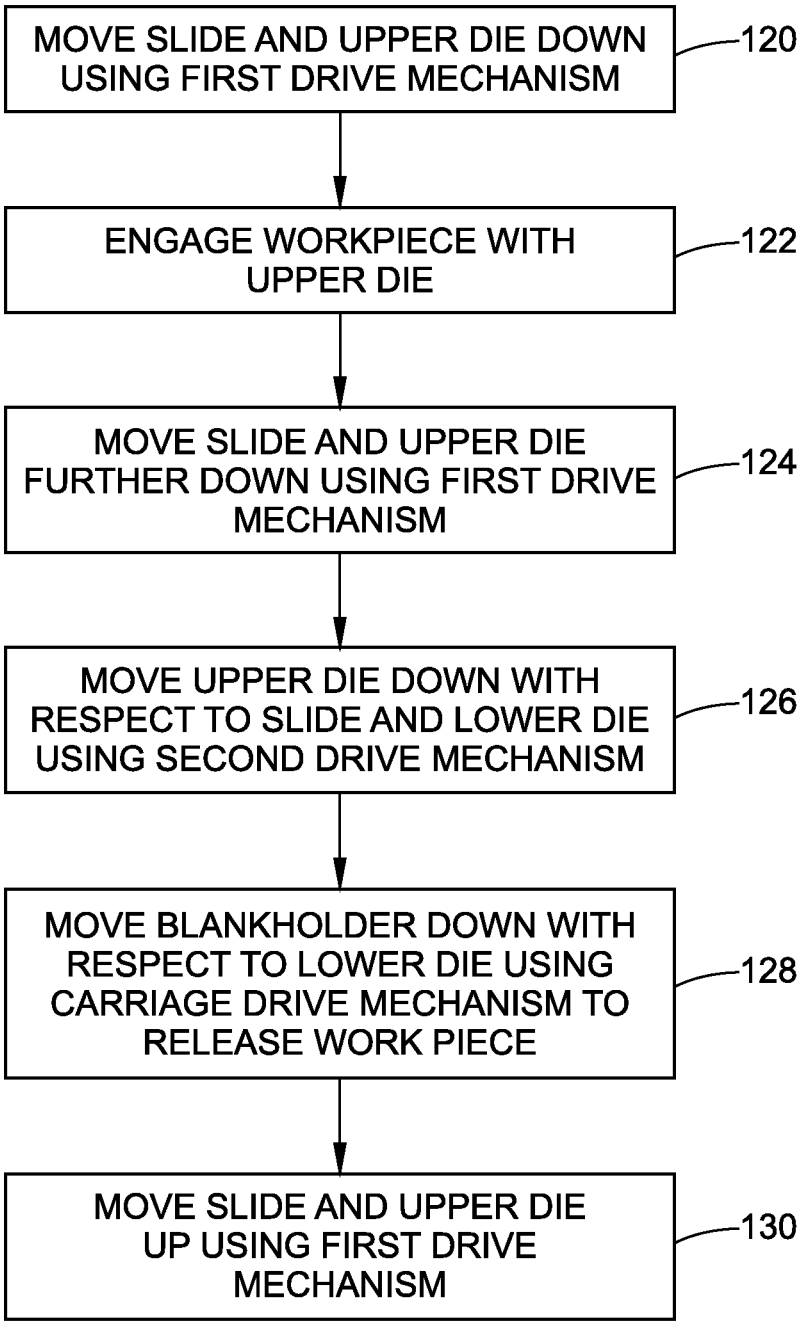
FIG. 3 is a flow diagram depicting a method for drawing a metal part.
Figure 6:
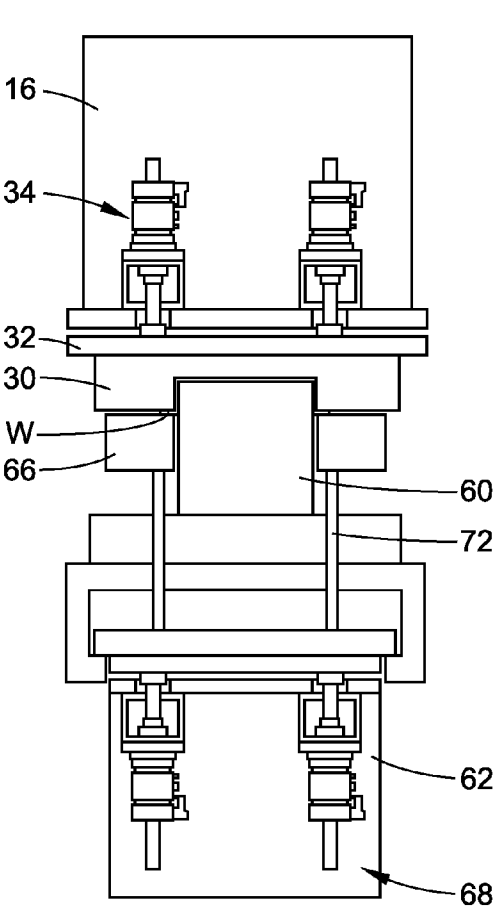
FIGS. 4-6 are schematic depictions of the draw press at different stages during the method for drawing a metal part.

With reference to an embodiment shown in FIG. 3, the method for drawing a metal part includes, at 120, moving the slide 16 (FIG. 1) and the upper die 30 (FIG. 1) toward a work piece W positioned on the lower die 60 (FIG. 1) using the first (eccentric) drive mechanism 14 (FIG. 1). As compared to movement of the slide 16 using servospindles, similar to the servospindles 36 and 98, the eccentric drive mechanism 14 has a fast cycle time and can provide high surface quality to the drawn part.

Figure 5:
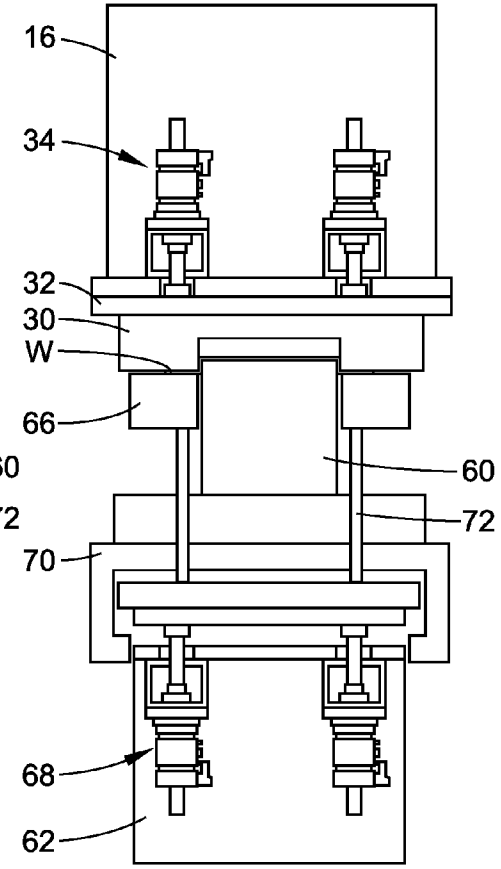
Figure 4:
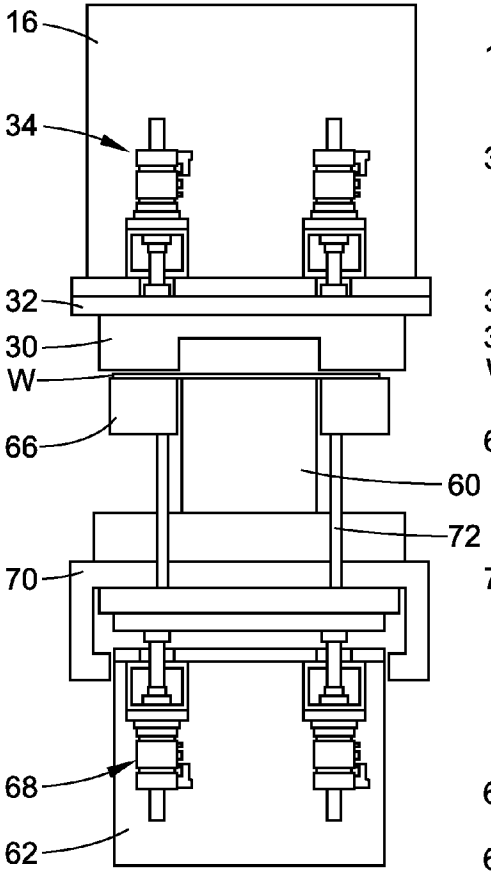

At 122, the method further includes engaging the work piece W with the upper die 30 (see FIG. 4). At 124, the method further includes moving the slide 16 and the upper die 30 further toward the lower die 60 still using the first drive mechanism 14. This downward movement of the upper die 30 results in downward movement of the blankholder 66 adjacent to the lower die 60 and downward movement of the cushion slide 62 connected with the blankholder 66 (see FIG. 5). As discussed above, the hydraulic cylinders 82 can control the force on the blankholder 66. The downward movement of the slide 16 and the upper die 30 continues until the slide 16 has moved the first distance $d_1$, which is based on the eccentricity e of the first drive mechanism 14. The slide 16 is capable of moving the entire distance $d_1$, but the slide 16 can be moved any fraction thereof. Only the entire distance $d_1$ is limited by the eccentric drive 14.

After the slide 16 has moved the first distance $d_1$ the method for drawing a metal part further includes, at 126, moving the upper die 30 with respect to the slide 16 and the lower die 60 using the second drive mechanism 34, which is connected with the slide 16 for movement therewith. As explained above, the second drive mechanism 34 is operably connected with the upper die 30 to allow for relative movement of the upper die 30 with respect to the slide 16. The method for drawing a metal part further includes, at 128, lowering the blankholder 66 with respect to the lower die 60. In one embodiment, the blankholder 66 can be lowered using the carriage drive mechanism 68, which is the servospindle drive mechanism 98 operatively connected with the blankholder 66 and disposed within the cushion slide 62. The blankholder 66 is lowered after moving the upper die 30 with respect to the slide 16 and the lower die 60 further downward using the second drive mechanism 34 connected with the slide 16.

Figure 7:
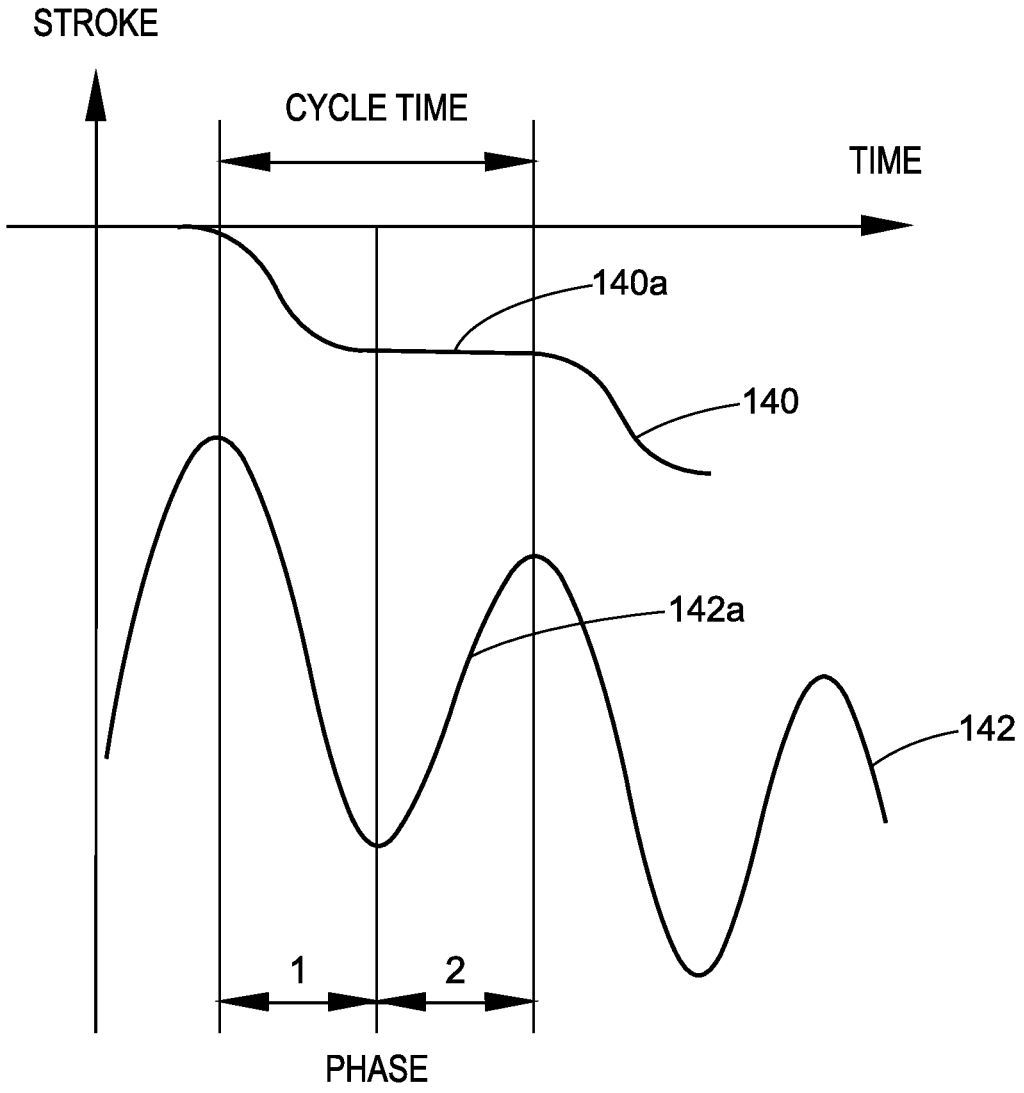
FIG. 7 is a graph depicting movement of an upper die and movement of a blankholder of the draw press of FIG. 1 during a draw press operation.

The second drive mechanism 34 in the slide 16 and the carriage drive mechanism 68 in the cushion slide 62 can each pulsate to allow for a deeper draw of the work piece W. The spindles 40 of the second drive mechanism 34 and the spindles 102 of the carriage drive mechanism 68 index with each pulsation. For example, with respect to FIG. 7 movement of the upper die 30 is depicted by line 140 and movement of the blankholder 66 is depicted by line 142. The upper die 30 moves downward with respect to the slide 16 as it is being driven by the second drive mechanism 34. The blankholder 66 also moves downward with respect to the lower die 60. The downward movement of the upper die 30 (e.g., step 126) then stops (see section 140*a* of line 140). The blankholder 66 continues to be drawn downward by the carriage drive mechanism 68 after the downward movement of the upper die 30 has ceased so as to release the work piece W (step 128) to allow for metal to flow inward to reduce the likelihood of tearing and allow for a deeper draw. After the blankholder 66 has retreated (i.e., been drawn downward), the carriage drive mechanism 68 moves the carriage 64 upward (see section 142*a*) to reengage the blankholder 66 with the work piece W. The upper die 30 and the blankholder 66 are then both driven further downward. The upper die 30 is driven by the second drive mechanism 34 (step 126 is repeated). The blankholder 66 is driven by the carriage drive mechanism 68. This further downward movement of the upper die 30 then stops again, and then the blankholder 66 is again drawn downward by the carriage drive mechanism 68. Steps 126 and 128 in FIG. 3 can be repeated as many times as necessary to form the desired deep drawn work piece W. These movements can be in the form of pulsations, which can be at a frequency greater than 15 Hz. In another non-limiting example, the frequency may be about 50 Hz. This has been found to provide desirable results for form pressing aluminum. After the work piece has been formed into its desired shape, the slide 16 and the upper die 30 can be moved upward.

The draw press and method for drawing a metal part have been described above with particularity. However, modifications and alterations will occur to those upon reading and understanding the preceding detailed description. Accordingly, the invention is not limited only to the embodiments described above. Instead, the invention is defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A draw press comprising:

a lower die;

a carriage moveable toward a lower die;

an upper die movably secured to the carriage, the upper die movable with respect to the carriage to draw a work piece, wherein the carriage is movable downward toward the lower die to position the upper die with respect to the lower die in a workpiece engagement position, and wherein the upper die is movable with respect to the carriage downward away from the workpiece engagement position toward the lower die to position the upper die in a drawing position wherein the workpiece may be drawn; and a first drive mechanism operably connected to the carriage to move the carriage, and a second drive mechanism secured to the carriage and operably connected to the upper die to move the upper die.

2. The draw press of claim 1, wherein the first drive mechanism includes a first drive mechanism servomotor, a gear train, an eccentric ring and a connecting rod, and wherein the second drive mechanism includes a second drive mechanism servomotor connected with a spindle, which cooperates with a spindle nut.

3. The draw press of claim 1, wherein the carriage defines a chamber therein and the second drive mechanism is at least partially positioned in the chamber.

4. The draw press of claim 1, wherein the second drive mechanism includes a motor, and a spindle directly driven by the drive, wherein the spindle rotates about an axis that is parallel to the direction of movement of the upper die.

5. The draw press of claim 4, further comprising a spindle nut secured to the upper die, wherein the motor of the second drive mechanism is secured to the carriage and the spindle is rotatably secured to the spindle nut.

6. The draw press of claim 1, wherein the second drive mechanism is configured to provide pulsating movement of the upper die with respect to the carriage.

7. A draw press comprising:

a lower die;

a carriage moveable toward a lower die;

an upper die movably secured to the carriage, the upper die movable with respect to the carriage to draw a work piece, wherein the carriage is movable downward toward the lower die to position the upper die with respect to the lower die in a workpiece engagement position, and wherein the upper die is movable with respect to the carriage downward away from the workpiece engagement position toward the lower die to position the upper die in a drawing position wherein the workpiece may be drawn; and a first drive mechanism operably connected to the carriage to move the upper die at a first frequency, and a second drive mechanism operably connected to the upper die to move the upper die at a second frequency that is greater than the first frequency.

8. The draw press of claim 7, wherein the second drive mechanism is capable of moving the upper die at a frequency of at least 15 Hz.

9. The draw press of claim 7, wherein the carriage is movable downward from the workpiece engagement position toward the lower die to position the upper die in a first drawing position wherein the workpiece may be drawn to a first depth, and wherein the upper die is extendable away from the carriage and the first drawing position downward toward the lower die to a second drawing position wherein the workpiece may be drawn to a second depth.

10. A method for drawing a metal part comprising:

moving a carriage and an upper die operably connected thereto toward a work piece positioned on a lower die to engage the upper die with the work piece at a workpiece engagement position; and moving the upper die with respect to the carriage downward toward the lower die beyond the workpiece engagement position to draw the work piece.

11. The method of claim 10, further comprising moving the carriage downward toward the lower die after the upper die engages the work piece to move the upper die from the workpiece engagement position toward the lower die to a first drawing position to draw the work piece a first depth.

12. The method of claim 11, wherein the upper die is extended from the carriage and the first drawing position downward toward the lower die to a second drawing position to draw the work piece a second depth, wherein the second depth is greater than the first depth.

13. The method of claim 10, wherein the carriage moves the upper die a first distance, and the upper die is moved with respect to the carriage a second distance that is shorter than the first distance.

14. The method of claim 10, wherein a first drive mechanism is operably connected to the carriage to move the carriage and the first drive mechanism is an eccentric drive mechanism.

15. A draw press comprising:

a first movable carriage;

an upper die movably secured to the carriage;

a lower die;

a blankholder for supporting a work piece positioned on the lower die;

a movable body; and a second carriage movably secured to the body and positioned between the lower die and the body, wherein the blankholder extends from the second carriage and the second carriage is movable between the body and the lower die to selectively position the blankholder with respect to the lower die.

16. The draw press of claim 15, wherein the first carriage is movable a first distance to move the upper die downward with respect to the lower die to a first drawing position wherein the work piece may be drawn a first depth, the upper die is movable downward with respect to the carriage and the lower die a second distance beyond the first drawing position to a second drawing position wherein the work piece may be drawn a second depth, wherein the second distance is shorter than the first distance, and wherein the second carriage is moved downward with respect to the lower die and the movable body to move the blankholder downward with respect to the lower die and the movable body as the upper die is moved to the second drawing position.

17. The draw press of claim 15, further comprising a first drive mechanism operably connected to the first carriage to move the first carriage, and a second drive mechanism secured to the first carriage and operably connected to upper die to move the upper die.

18. The draw press of claim 17, wherein the first carriage defines a chamber therein and the second drive mechanism is at least partially positioned in the chamber.

19. The draw press of claim 15, further comprising a first drive mechanism operably connected to the first carriage to move the first carriage, and a second drive mechanism operably connected to the upper die to move the upper die with respect to the carriage, wherein the second drive mechanism includes a motor secured to the first carriage, a drive directly driven by the motor, and one of a spindle and spindle nut connected to the drive, wherein the drive and one of the spindle and spindle nut rotate about an axis that is parallel to the direction of movement of the upper die.

20. The draw press of claim 15, further comprising a first drive mechanism operably connected to the first carriage to move the upper die at a first frequency, and a second drive mechanism operably connected to the upper die to move the upper die at a second frequency that is greater than the first frequency.

21. The draw press of claim 15, wherein the first carriage is movable to position the upper die in a first work piece engagement position, and the upper die is movable with respect to the carriage to a second work piece engagement position.

22. The draw press of claim 15, further comprising a third drive mechanism operably connected to the second carriage to move the second carriage, wherein the movable body is a cushion slide that is biased toward the upper die.

23. The draw press of claim 22, further comprising a hydraulic cylinder, wherein the movable cushion slide is biased with the hydraulic cylinder.

24. A method for drawing a metal part comprising:

providing a carriage and an upper die movably secured to the carriage;

moving the carriage toward a work piece positioned on a lower die and a blankholder;

engaging the work piece with the upper die at an engagement position;

moving the carriage downward toward the lower die beyond the engagement position to draw the work piece a first depth;

moving the upper die with respect to the carriage and drawing the work piece with the upper die a second depth; and disengaging the blankholder from the work piece.

25. The method of claim 24, further comprising:

providing a second carriage, wherein the blankholder extends from the second carriage, wherein the second carriage is movably secured to a movable body, wherein the second carriage is positioned between the lower die and the body, wherein the step of disengaging the blankholder comprises moving the second carriage with the drive mechanism to move the second carriage and the blankholder downward with respect to the lower die to disengage the blankholder from the workpiece;

moving the second carriage to move the second carriage and the blankholder upward with respect to the lower die to engage the blankholder with the workpiece; and moving the upper die with respect to the carriage and drawing the work piece with the upper die a third depth.

26. The method of claim 25, wherein a drive mechanism is secured to the body and is operably connected to the second carriage to move the second carriage and the blankholder.

27. The method of claim 24, further comprising biasing the movable body toward the upper die.

28. The method of claim 27, wherein biasing the movable body further includes biasing the movable body with a hydraulic cylinder.

29. The method of claim 25, wherein the second depth is greater than the first depth.

30. The method of claim 24, wherein the carriage moves the upper die a first distance, and the upper dies is moved with respect to the carriage a second distance that is shorter than the first distance.

31. The method of claim 24, wherein a first drive mechanism is operably connected to the carriage to move the upper die at a first frequency, and a second drive mechanism is operably connected to the upper die to move the upper die at a second frequency that is greater than the first frequency.

32. A draw press comprising:

a lower die;

a carriage positioned above the lower die and moveable downward toward the lower die;

an upper die movably secured to the carriage;

a first drive mechanism operably connected to the carriage to move the upper die downward toward the lower die to a workpiece engagement position, and move the upper die downward with respect to the lower die beyond the workpiece engagement position to a first draw position wherein the a work piece may be drawn a first depth; and a second drive mechanism operably connected to the upper die to move the upper die downward with respect to the lower die beyond the first draw position to a second draw position wherein the work piece may be drawn to a second depth.

33. The draw press of claim 32, wherein the first drive mechanism moves the upper die at a first frequency, and the second drive mechanism moves the upper die at a second frequency that is greater than the first frequency.

34. The draw press of claim 32, wherein the second drive mechanism moves the upper die at a frequency of at least 15 Hz.

35. A method for drawing a metal part comprising:

moving an upper die with a first drive mechanism toward a lower die and a work piece positioned on the lower die to a work piece engagement position wherein the work piece is engaged with the upper die; and moving the upper die with a second drive mechanism to draw the work piece.

36. The method of claim 35, further comprising moving the upper die with the first drive mechanism downward with respect to the lower die beyond from the work piece engagement position to a first draw position to draw the work piece a first depth.

37. The method of claim 36, wherein the upper die is moved with the second drive mechanism downward with respect to the lower die beyond the first draw position to a second draw position to draw the work piece to a second depth.

38. The method of claim 37, wherein the second depth is greater than the first depth.

39. The method of claim 35, wherein the first drive mechanism moves the upper die a first distance, and the second drive mechanism moves the upper die a second distance that is shorter than the first distance.

40. The method of claim 39, wherein the first drive mechanism moves the upper die at a first frequency, and the second drive mechanism moves the upper die at a second frequency that is greater than the first frequency.

41. A draw press comprising:

a lower die;

a carriage moveable toward a lower die; and an upper die movably secured to the carriage, the upper die movable with respect to the carriage to draw a work piece, wherein the carriage is movable downward toward the lower die to position the upper die with respect to the lower die in a workpiece engagement position, and wherein the upper die is movable with respect to the carriage downward away from the workpiece engagement position toward the lower die to position the upper die in a drawing position wherein the workpiece may be drawn;

wherein the carriage is movable downward from the workpiece engagement position toward the lower die to position the upper die in a first drawing position wherein the workpiece may be drawn to a first depth, and wherein the upper die is extendable away from the carriage and the first drawing position downward toward the lower die to a second drawing position wherein the workpiece may be drawn to a second depth.

42. The draw press of claim 41, further comprising a first drive mechanism operably connected to the carriage to move the carriage, and a second drive mechanism secured to the carriage and operably connected to the upper die to move the upper die.

43. The draw press of claim 42, wherein the carriage defines a chamber therein and the second drive mechanism is at least partially positioned in the chamber.

44. A method for drawing a metal part comprising:

moving an upper die with a first drive mechanism toward a work piece positioned on a lower die; and moving the upper die with a second drive mechanism to draw the work piece, wherein the first drive mechanism moves the upper die a first distance, and the second drive mechanism moves the upper die a second distance that is shorter than the first distance.

45. The method of claim 44, wherein the first drive mechanism moves the upper die at a first frequency, and the second drive mechanism moves the upper die at a second frequency that is greater than the first frequency.

46. A method for drawing a metal part comprising:

moving an upper die with a first drive mechanism toward a work piece positioned on a lower die; and moving the upper die with a second drive mechanism to draw the work piece, wherein the first drive mechanism moves the upper die at a first frequency, and the second drive mechanism moves the upper die at a second frequency that is greater than the first frequency.

47. The method of claim 46, further comprising moving the upper die with the first drive mechanism toward the lower die to a work piece engagement position wherein the work piece is engaged with the upper die.

48. The method of claim 47, further comprising moving the upper die with the first drive mechanism downward with respect to the lower die beyond from the work piece engagement position to a first draw position to draw the work piece a first depth.

49. The method of claim 48, wherein the upper die is moved with the second drive mechanism downward with respect to the lower die beyond the first draw position to a second draw position to draw the work piece to a second depth.

* * * * *